US005485647A

United States Patent [19]

Durst

[11] Patent Number: 5,485,647

[45] Date of Patent: Jan. 23, 1996

[54] SPORTING EVENT SCRAPER BRUSH

[76] Inventor: Larry Durst, 1139 Bunkerhill Dr., Troy, Ohio 45373

[21] Appl. No.: 329,285

[22] Filed: Oct. 26, 1994

[51] Int. Cl.[6] ..... A47L 25/00

[52] U.S. Cl. ..... 15/111; 15/236.01; 15/236.07

[58] Field of Search ..... 15/111, 236.01, 15/236.02, 236.07; 30/169; D4/118

[56] References Cited

U.S. PATENT DOCUMENTS

| | | | |
|---|---|---|---|
| D. 218,388 | 8/1970 | Whitaker | D4/118 |
| 1,018,518 | 2/1912 | Pettit | 15/236.01 |
| 1,442,559 | 1/1923 | Doty | 15/236.01 |
| 4,790,045 | 12/1988 | Doherty | 15/236.01 |
| 5,351,350 | 10/1994 | Johnson | 15/111 |

FOREIGN PATENT DOCUMENTS

| | | | |
|---|---|---|---|
| 655247 | 1/1938 | Germany | 15/236.07 |

*Primary Examiner*—Edward L. Roberts, Jr.

[57] ABSTRACT

A scraping brush from cleaning dirt and debris from a surface. The inventive device includes a handle having a brush extending from a first end thereof and a scraping block extending from a second end thereof. The scraping block is configured to include a planar rear face oriented at an oblique angle relative to a planar front face, with a pair of arcuate lateral faces intersecting both the planar front and rear faces.

1 Claim, 3 Drawing Sheets

SPORTING EVENT SCRAPER BRUSH

BACKGROUND OF THE INVENTION

1. Field of the Invention

The present invention relates to cleaning devices and more particularly pertains to a sporting event scraper brush for cleaning dirt and debris from a surface.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning devices include U.S. Pat. Nos. 3,659,303; 4,057,353; 5,077,858; 5,114,256; and U.S. Pat. Des., No. 342,833.

While these devices fulfill their respective, particular objectives and requirements, the aforementioned patents do not disclose a scraping brush for cleaning dirt and debris from a surface which includes a handle having a brush extending from a first end thereof and a scraping block extending from a second end thereof, wherein the scraping block includes a planar front face oriented at an oblique angle relative to a planar rear face so as to define a scraping apex, with a pair of arcuate lateral faces intersecting both the front and rear faces.

In these respects, the sporting event scraper brush according to the present invention substantially departs from the conventional concepts and designs of the prior art, and in so doing provides an apparatus primarily developed for the purpose of cleaning dirt and debris from a surface, such as a base or home plate of a baseball diamond.

SUMMARY OF THE INVENTION

In view of the foregoing disadvantages inherent in the known types of cleaning devices now present in the prior art, the present invention provides a new sporting event scraper brush construction wherein the same can be utilized for cleaning dirt and debris from a surface. As such, the general purpose of the present invention, which will be described subsequently in greater detail, is to provide a new sporting event scraper brush apparatus and method which has many of the advantages of the cleaning devices mentioned heretofore and many novel features that result in a sporting event scraper brush which is not anticipated, rendered obvious, suggested, or even implied by any of the prior art cleaning devices, either alone or in any combination thereof.

To attain this, the present invention generally comprises a scraping brush from cleaning dirt and debris from a surface. The inventive device includes a handle having a brush extending from a first end thereof and a scraping block extending from a second end thereof. The scraping block is configured to include a planar rear face oriented at an oblique angle relative to a planar front face, with a pair of arcuate lateral faces intersecting both the planar front and rear faces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sporting event scraper brush apparatus and method which has many of the advantages of the cleaning devices mentioned heretofore and many novel features that result in a sporting event scraper brush which is not anticipated, rendered obvious, suggested, or even implied by any of the prior art cleaning devices, either alone or in any combination thereof.

It is another object of the present invention to provide a new sporting event scraper brush which may be easily and efficiently manufactured and marketed.

It is a further object of the present invention to provide a new sporting event scraper brush which is of a durable and reliable construction.

An even further object of the present invention is to provide a new sporting event scraper brush which is susceptible of a low cost of manufacture with regard to both materials and labor, and which accordingly is then susceptible of low prices of sale to the consuming public, thereby making such sporting event scraper brushes economically available to the buying public.

Still yet another object of the present invention is to provide a new sporting event scraper brush which provides in the apparatuses and methods of the prior art some of the advantages thereof, while simultaneously overcoming some of the disadvantages normally associated therewith.

Still another object of the present invention is to provide a new sporting event scraper brush for cleaning dirt and debris from a surface, such as a base or home plate of a baseball diamond.

Yet another object of the present invention is to provide a new sporting event scraper brush which includes a handle having a brush extending from a first end thereof and a scraping block extending from a second end thereof, wherein the scraping block includes a planar front face oriented at an oblique angle relative to a planar rear face so as to define a scraping apex, with a pair of arcuate lateral faces intersecting both the front and rear faces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
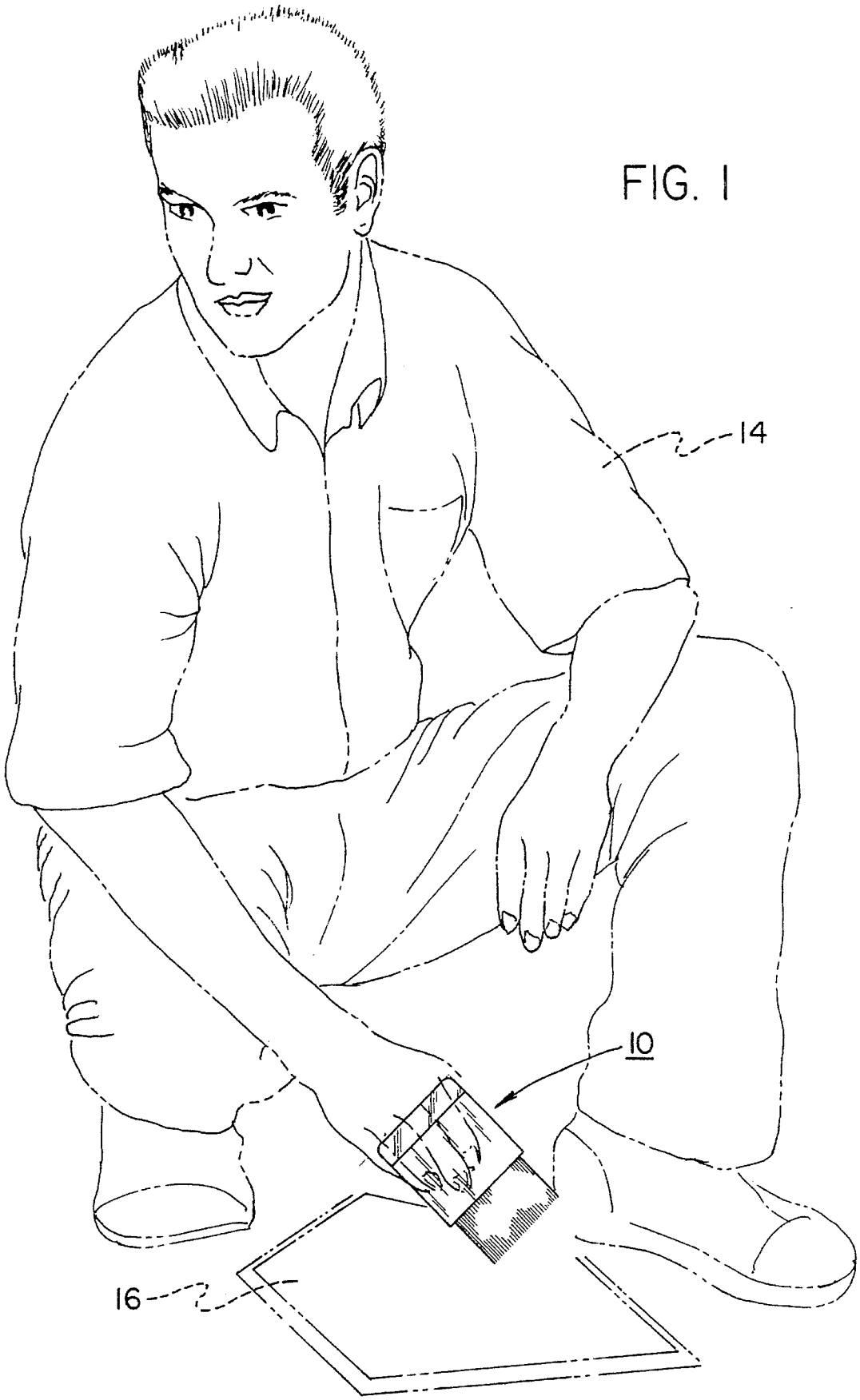
FIG. 1 is an isometric illustration of a sporting event scraper brush according to the present invention.

With reference now to the drawings, and in particular to FIGS. 1–5 thereof, a new sporting event scraper brush embodying the principles and concepts of the present invention and generally designated by the reference numeral 10 will be described.

More specifically, it will be noted that the sporting event scraper brush 10 comprises a handle 12 for grasping and manipulating by an individual 14 to effect scraping and cleaning of a base 16 of a baseball diamond or the like, such as the home plate base illustrated in FIG. 1. A brush means 18 extends from a first end 20 of the handle 2 and can be utilized to brush loose dirt and debris from the base 16. A scraping means 22 extends from a second end 24 of the handle 12 and can be utilized to scrape and mechanically remove attached dirt and debris from the base 6.

Figure 2:
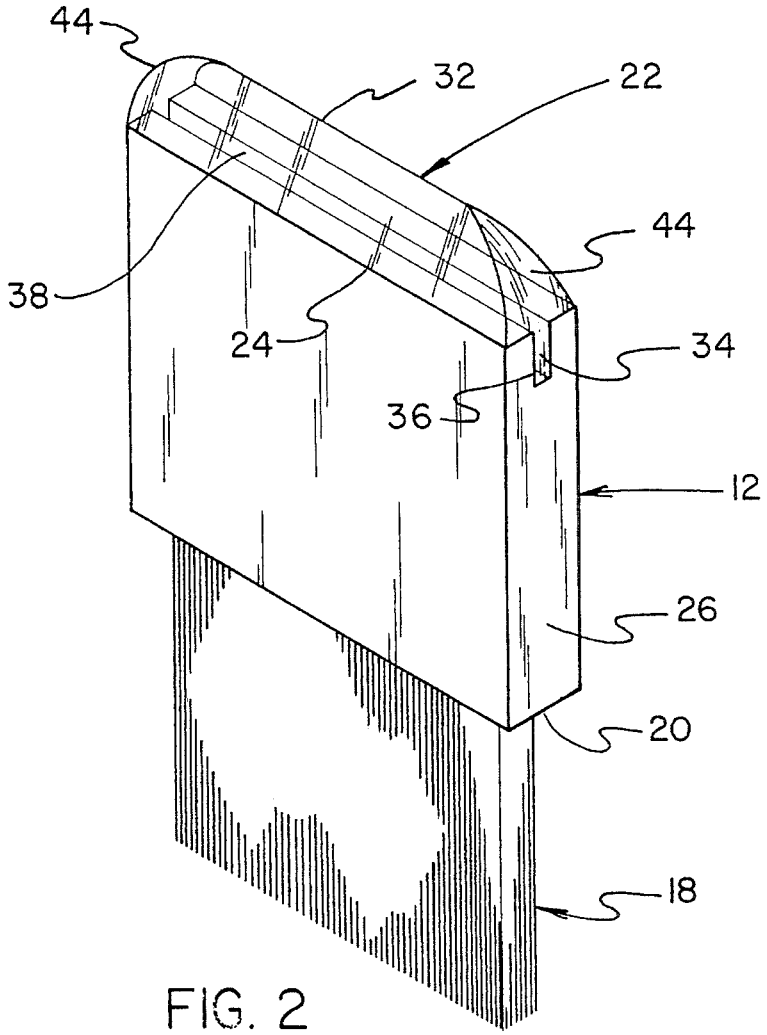
FIG. 2 is an isometric illustration of the sporting event scraper brush, per se.

As best illustrated in FIG. 2, the handle comprises a substantially rectangular block 26 having an unlabeled front face spaced from and parallel to an unlabeled rear face, with a pair of lateral end faces extending orthogonally between the front and rear faces. Further, the first end 20 of the handle 12 is defined by a bottom face extending substantially orthogonally relative to the front face and the lateral end faces, with the second end 24 being defined by a top face extending spaced from and parallel to the bottom face so as to define the substantially rectangular shape of the handle block 26.

Figure 4:
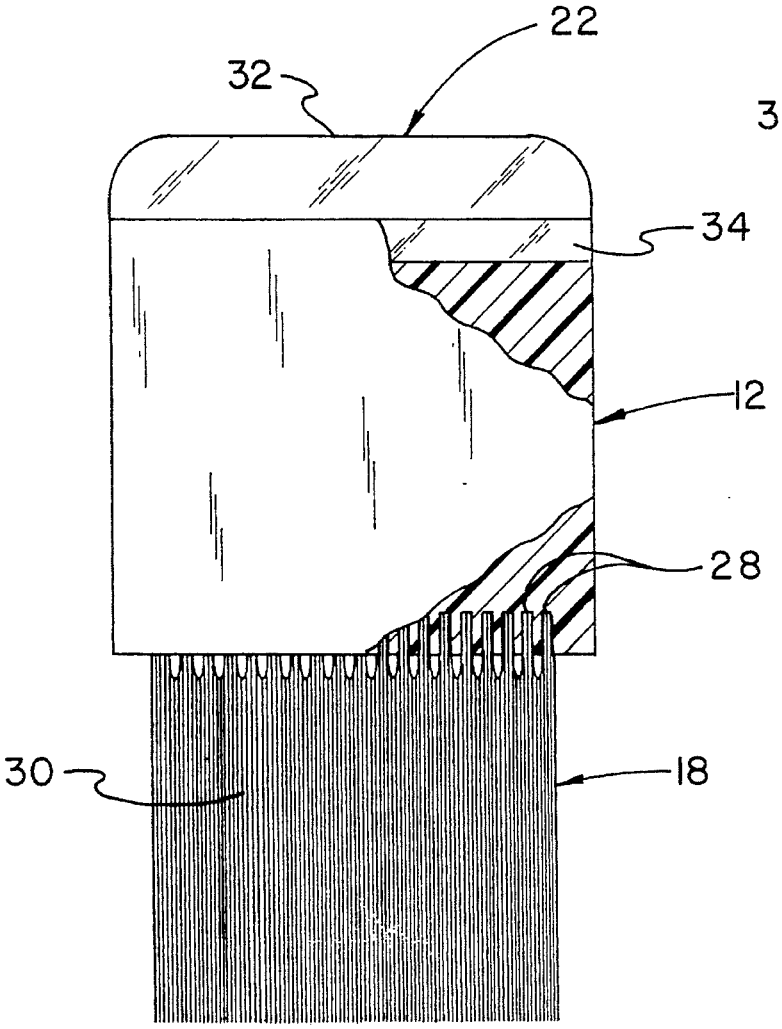
FIG. 4 is a front elevation view, partially in cross section of the present invention.
Figure 5:
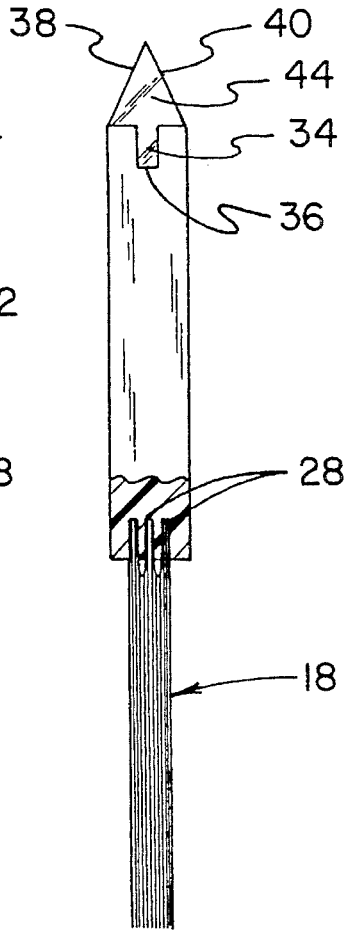
FIG. 5 is a side elevation view, partially in cross section, of the present invention.

As shown in FIGS. 4 and 5, a matrix of mounting apertures 28 are directed into the bottom face of the handle block 26, with each of the mounting apertures receiving a plurality of bristles 30 so as to define the brush means 18 of the present invention 10. The bristles 30 are preferably constructed of a substantially resilient material suitable for brushing and wiping of the base 16 to remove dirt and debris therefrom.

Figure 3:
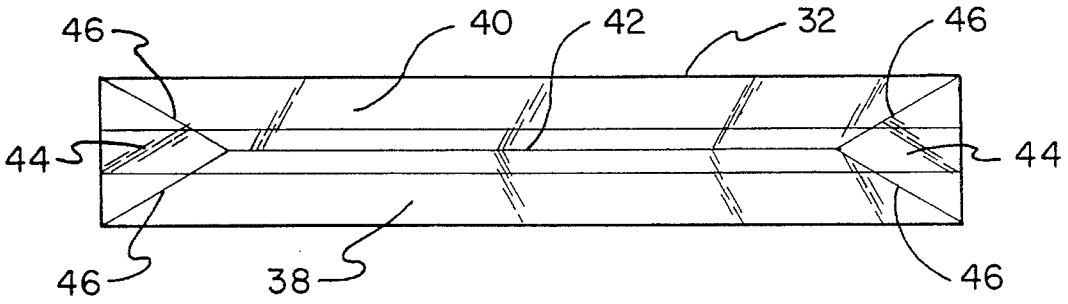
FIG. 3 is a top plan view thereof.

As best illustrated in FIGS. 2, 3, and 5, the scraping means 22 of the present invention 10 preferably comprises a scraping block 32 having a longitudinal projection 34 received within a mounting groove 36 formed along the top face of the handle block 26. The mounting groove 36 extends from a first one of the lateral end walls across the top wall and terminates at a second one of the lateral end walls. The longitudinal projection 34 of the scraping block 32 is frictionally received within the mounting groove 36, with adhesive or other fasteners being desirably utilized to further secure the longitudinal projection, and hence the scraping block 32, relative to the handle 12.

The scraping block 32 is shaped so as to define a planar front face 38 which extends from the top face of the handle block 26 at an oblique angle relative thereto and intersects a planar rear face 40 of the scraping block 32 which similarly projects from the top face of the handle block. The front and rear faces 38, 40 are oriented at an oblique angle relative to one another and cooperate to define a scraping apex 42 which can be utilized to mechanically engage and scrape the base 16 to remove attached dirt and debris therefrom. Further, the scraping block 32 is shaped so as to define respectively opposed arcuate lateral faces 44 which extend from the top face of the handle block 26 at an oblique angle relative thereto so as to intersect both the front and rear faces 38 and 40 to define opposed pairs of arcuate lateral scraping apexes 46. The arcuate lateral apexes 46 can be utilized to clean a perimeter of the base 16 and are further operable to clean the convex or otherwise arcuate surface.

In use, the sporting event scraper brush 10 can be utilized to clean a base 16 of a baseball diamond, such as a home plate or the like, wherein the brush means 18 is operable to brush away unattached dirt and debris from the base. However, during wet or damp conditions, dirt and debris typically become securely attached to the base 16, whereby the scraping means 22 can be utilized to effect a scraping or mechanical removal of the attached dirt and debris from the home plate. The device 10 is preferably sized so as to fit conveniently within a pocket or the like for ready access during short intermissions within the playing of a baseball game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sporting event scraper brush comprising:

a handle for grasping and manipulating by an individual, said handle comprising a substantially rectangular handle block having a front face spaced from and parallel to a rear face, with a pair of lateral end faces extending orthogonally between said front and rear faces, a first end of said handle being defined by a bottom face extending substantially orthogonally relative to said front face and said lateral end faces, with a second end of said handle being defined by a top face extending spaced from and substantially parallel to said bottom face so as to define a substantially rectangular shape of said handle block, said handle block being shaped so as to define a mounting groove extending from a first one of said lateral end walls across the top wall and terminating at a second one of said lateral end walls, the mounting groove extending through both of the lateral end walls;

a brush means extending from said first end of said handle for brushing loose dirt and debris from a surface; and, a scraping means extending from said second end of said handle for scraping and mechanically removing attached dirt and debris from said surface, said scraping means comprising a scraping block secured to a top face of said handle block, said scraping block being shaped so as to define a planar front face which extends from said top face of said handle block at an oblique angle relative thereto, a planar rear face projecting from said tip face of said handle block and intersecting said planar front face of said scraping block, said front and rear faces being oriented at an oblique angle relative to one another and cooperating to define a scraping apex which can be utilized to mechanically engage and scrape said surface, said scraping block being further shaped so as to define respectively opposed arcuate lateral faces which extend from said top face of said handle block to intersect both said front and rear faces to define opposed pairs of arcuate lateral scraping apexes, wherein said arcuate lateral apexes can be utilized to clean an arcuate surface, said scraping block including an elongated longitudinal projection received within the mounting groove extending along the top face of the handle block, the longitudinal projection being frictionally and removably retained within the mounting groove so as to permit for selective removal of the scraping block from the handle block.

* * * * *